US009816527B2

(12) United States Patent
Koebrich et al.

(10) Patent No.: US 9,816,527 B2
(45) Date of Patent: Nov. 14, 2017

(54) PUMP WITH INTEGRATED HEATING ELEMENT

(71) Applicant: E.G.O. Elektro-Geraetebau GmbH, Oberderdingen (DE)

(72) Inventors: Holger Koebrich, Kraichtal-Gochsheim (DE); Tobias Albert, Kraichtal (DE); Volker Block, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 636 days.

(21) Appl. No.: 14/377,726

(22) PCT Filed: Feb. 6, 2013

(86) PCT No.: PCT/EP2013/052353

§ 371 (c)(1),
(2) Date: Aug. 8, 2014

(87) PCT Pub. No.: WO2013/117603

PCT Pub. Date: Aug. 15, 2013

(65) Prior Publication Data

US 2015/0086325 A1 Mar. 26, 2015

(30) Foreign Application Priority Data

Feb. 10, 2012 (DE) ..... 10 2012 202 065

(51) Int. Cl.
*F04D 29/58* (2006.01)
*A47L 15/42* (2006.01)
(Continued)

(52) U.S. Cl.
CPC ..... *F04D 29/5866* (2013.01); *A47L 15/4225* (2013.01); *A47L 15/4285* (2013.01);
(Continued)

(58) Field of Classification Search
CPC .. F04D 29/5866; F04D 29/586; F04D 27/006; A47L 15/4285; A47L 15/4287
See application file for complete search history.

(56) References Cited

U.S. PATENT DOCUMENTS 7,287,536 B2 10/2007 Steck et al.
7,293,958 B2 11/2007 Kraffzik
(Continued)

FOREIGN PATENT DOCUMENTS

CN 1702334 A 11/2005
CN 1727696 A 2/2006
(Continued)

OTHER PUBLICATIONS

State Intellectual Property Office of the P.R.C., First Office Action for Application No. 201380019363.3, Dec. 31, 2015, 10 pages, China.
International Searching Authority, International Search Report for International Application No. PCT/EP2013/052353, dated May 27, 2013, 5 pages, European Patent Office, The Netherlands.

*Primary Examiner* — Gregory Anderson
*Assistant Examiner* — Juan G Flores
(74) *Attorney, Agent, or Firm* — Alston & Bird LLP

(57) ABSTRACT

A pump for a dishwasher is configured as an impeller pump having a central water inflow to a rotating impeller for conveying the water in the radial direction out of the impeller into a pump chamber which surrounds the impeller in a ring-like manner and has a heated pump chamber wall on its outer side. Here, the pump has an outlet in the end region of the pump chamber at an axial spacing from the impeller. Heating elements which have a decreasing power output with regard to the area power output in the axial direction of the pump toward the outlet are arranged on the pump chamber wall. An input of energy into the pump chamber can thus be varied and in the process adapted depending on a turbulent or laminar flow.

9 Claims, 4 Drawing Sheets

(51) Int. Cl.

| | |
|---|---|
| ***D06F 39/08*** | (2006.01) |
| ***F04D 29/42*** | (2006.01) |
| ***F04D 19/00*** | (2006.01) |
| ***F04D 27/00*** | (2006.01) |

(52) U.S. Cl.
CPC ..... *D06F 39/085* (2013.01); *F04D 19/00* (2013.01); *F04D 27/006* (2013.01); *F04D 29/426* (2013.01); *F04D 29/584* (2013.01); *F04D 29/586* (2013.01); *F04D 29/588* (2013.01)

(56) References Cited

U.S. PATENT DOCUMENTS

| | | | | |
|---|---|---|---|---|
| 7,607,895 | B2 | 10/2009 | Marioni | |
| 8,245,718 | B2 * | 8/2012 | Busing | A47L 15/4225 134/108 |

FOREIGN PATENT DOCUMENTS

| | | | | |
|---|---|---|---|---|
| DE | 19803506 | A1 | 8/1999 | |
| DE | 19858137 | A1 | 6/2000 | |
| DE | 102007017271 | A1 | 10/2008 | |
| DE | 102008050895 | A1 | 4/2010 | |
| GB | 2427437 | A | 12/2006 | |
| JP | S58-72699 | A | 4/1983 | |
| WO | WO 2008125488 | A2 * | 10/2008 | A47L 15/4225 |

* cited by examiner

PUMP WITH INTEGRATED HEATING ELEMENT

CROSS-REFERENCE TO RELATED APPLICATIONS

This application is a National Stage application, filed under 35 U.S.C. §371, of International Application PCT/EP2013/052353, filed Feb. 6, 2013, which claims priority to German Application No. 10 2012 202 065.9 filed Feb. 10, 2012 both of which are hereby incorporated by reference in their entirety.

TECHNOLOGICAL FIELD

The invention relates to a pump, as can be used, in particular, for a water-conducting domestic appliance such as a dishwasher or a washing machine. Furthermore, the invention relates to a method for heating a pump, in particular an abovementioned pump according to the invention.

A pump of the generic type is known, for example, from DE 102007017271 A1.

BACKGROUND

The invention is based on the problem of providing a pump as mentioned at the outset and a corresponding method for heating a pump, by way of which problems of the prior art can be avoided, in particular with regard to limescale formation on a heated pump chamber wall, with at the same time thermal coupling which is as effective as possible into the conveyed liquid.

BRIEF SUMMARY

This problem is solved by way of a pump and a method for heating a pump. Advantageous and preferred refinements of the invention are the subject matter of the further claims and will be explained in greater detail in the following text. Here, some of the features are described only for the pump or only for the method. Regardless of this, however, it is to be possible for them to apply both to the pump and to the method. The wording of the claims is made by way of express reference to the content of the description.

The pump is configured as an impeller pump having a central water inflow to a rotating impeller, in order to convey water in the radial direction out of the impeller into a pump chamber which surrounds the impeller in a ring-like manner. The pump chamber is delimited on its outer side by an at least partially heated pump chamber wall. Furthermore, the pump has an outlet at an axial spacing from the impeller in the end region of the pump chamber, which outlet emanates or protrudes, in particular, in the tangential direction from the pump chamber wall. The outlet can advantageously be spaced apart axially from the impeller to such an extent that, as viewed in the axial direction, it lies approximately at the level of the water inflow.

It is provided according to the invention that heating elements are provided or are arranged on the pump chamber wall. The heating elements have a decreasing power output with regard to the generated or resulting area power output in the axial direction of the pump toward the outlet. This means that the generation of heat or heating effect of the heating elements can become lower in regions in the axial direction from the impeller to the outlet.

It can be achieved by way of the invention that a greater heating power output can be coupled in in the region where the water, exiting from the impeller, is still relatively cold. Such a large quantity of heating power output can then no longer be coupled into the water which flows toward the outlet in the axial course and becomes warmer in this direction, and/or there can be the risk of local overheating which can lead to increased precipitation of limescale which is contained or the like in the water and is undesirable on the heating elements or the pump chamber wall itself. Local overheating locations can thus also be avoided. Above all, as a result of reduced overheating of the water, the formation of limescale on the pump chamber wall can be reduced, which is generally disruptive and then in turn impairs the degree of efficiency of the heating.

Furthermore, it is possible that the area power output is higher in that region of the pump chamber, in which the flow of the conveyed liquid tends to be turbulent in the lowermost region of the pump chamber close to the outlet from the impeller, and becomes lower in the transition to the region, in which the flow then tends to be laminar, or becomes relatively lower for the first time in the region.

In one refinement of the invention, the heating elements are advantageously film heating elements. They can have a constant film thickness and can preferably be thick film heating elements. Their power output density is sufficiently great.

In a further refinement of the invention, a plurality of heating elements can be provided which run substantially in the axial direction of the pump, in particular precisely in the axial direction. As viewed in this direction, the heating elements can have a smaller width or smaller cross section at the start close to the impeller than at their end close to the outlet or in the direction of the outlet. As a result of a smaller cross section, the heating elements in this region generate more heat or have a greater heat power output. Thus, for example, the abovementioned decrease in the heating power output can be performed in the axial direction. It can be provided here, in particular, that the width or the cross section increases continuously along the axial direction toward the outlet in the individual heating elements. Here, the thickness of the heating elements is advantageously selected to be constant, with the result that the influence can be defined more accurately.

In an alternative fundamental refinement of the invention, it can be provided that the heating elements run substantially transversely with respect to the axial direction of the pump. Here, they can advantageously in each case surround the pump chamber wall substantially in a ring-like manner, for example run around it by approximately 300° and then be connected or made contact with by way of their two ends on connecting rails or supply rails or the like as contacts. It can advantageously be provided here that the width or the cross section of an individual ring-like or partially ring-like heating element remains constant. The width or the cross section of heating elements which follow one another decreases, however, in the axial direction toward the outlet, with the result that the area power output of the heating on the pump chamber wall also decreases here in regions in the axial direction toward the outlet. If the spacings of the heating elements in the axial direction are not too great, a relatively continuous distribution of the area power output of the heating can thus also be achieved, likewise such that it decreases in the direction toward the outlet.

It can be provided in the abovementioned refinement of the invention that that heating element which is closest to the outlet has the greatest width or the greatest cross section. In this way, it can be achieved that there is actually the lowest area power output of the heating close to the outlet as a result of the arrangement of the individual heating element with the lowest power output in the region.

It can be provided in a further refinement of the invention as an additional fundamental alternative that the heating elements in turn run substantially transversely with respect to the axial direction toward the outlet. Here, in a similar manner to that mentioned above, they can surround the pump chamber wall in a ring-like manner as described above, in particular therefore do not run completely around it. It is then provided here that the spacing of the heating elements from one another increases in the axial direction toward the outlet, whereas the spacing was advantageously identical in the above-described variant of the invention. An area power output of the heating which becomes smaller in the axial direction can therefore likewise be achieved here by way of substantially equivalent or identical heating elements which are simply arranged at a greater spacing from one another. As long as the spacings of the heating elements do not become too great, that is to say do not exceed the width of the heating elements themselves considerably, for example, a satisfactory and largely continuous distribution of the area power output can still be achieved by way of the pump chamber wall which lies in between and is usually and advantageously composed of metal as carrier for the heating elements. The area power output can therefore decrease substantially continuously in the axial direction toward the outlet.

Approximately from four to twelve, particularly advantageously from six to ten, of the heating elements of ring-like configuration can be provided. A similar number of the abovementioned heating elements which run substantially in the axial direction can be provided.

The configuration of the pump chamber wall from a suitable material, in particular a metal such as a steel which is known from DE 198 03 506 A1 for thick film applications, as carrier for the heating elements is known to a person skilled in the art. The configuration of the heating elements using the thick film process is also familiar to a person skilled in the art, and the person skilled in the art can make recourse to methods which are known per se here. The same applies for any possibly present insulating layers, protective layers or electrical contacts.

It is advantageously provided that all the heating elements of the heating of the pump chamber wall are actuated simultaneously, particularly advantageously via a single supply connector.

It can therefore be achieved by way of the invention as a heating method that, in the method which was mentioned at the outset, the pump chamber wall can be heated by way of a plurality of distributed heating elements which advantageously cover substantially the entire pump chamber wall, even if they do not cover every region directly. The pump chamber wall is heated to a more pronounced effect in the region of a pump bottom under the impeller, in particular at the impeller outlet, than in the region of an outlet from the pump chamber wall, which outlet is arranged in the axial direction away from the pump bottom. In particular, the outlet is arranged as far as possible away from the pump bottom, that is to say, as it were, at the other end of the pump chamber or the pump chamber wall.

A change in the heating power output can be at least the factor 1.2 to 3, advantageously 1.5 to 2.5. This applies both to the electrical heating power output or area power output and to the abovementioned dimensions of the individual heating elements with regard to the width or thickness or conductor cross section.

Apart from the claims, these and further features are also apparent from the description and the drawings, the individual features being realized in each case on their own or in multiples in the form of sub-combinations in one embodiment of the invention and in other fields, and it being possible for the individual features to represent embodiments which are advantageous, patentable per se, and for which protection is claimed here. The division of the application into the individual sections and intermediate headings does not restrict the general validity of the comments made under the intermediate headings.

BRIEF DESCRIPTION OF THE SEVERAL VIEWS OF THE DRAWINGS

Exemplary embodiments of the invention are shown diagrammatically in the drawings and will be explained in greater detail in the following text. In the drawings.

DETAILED DESCRIPTION

Figure 1:
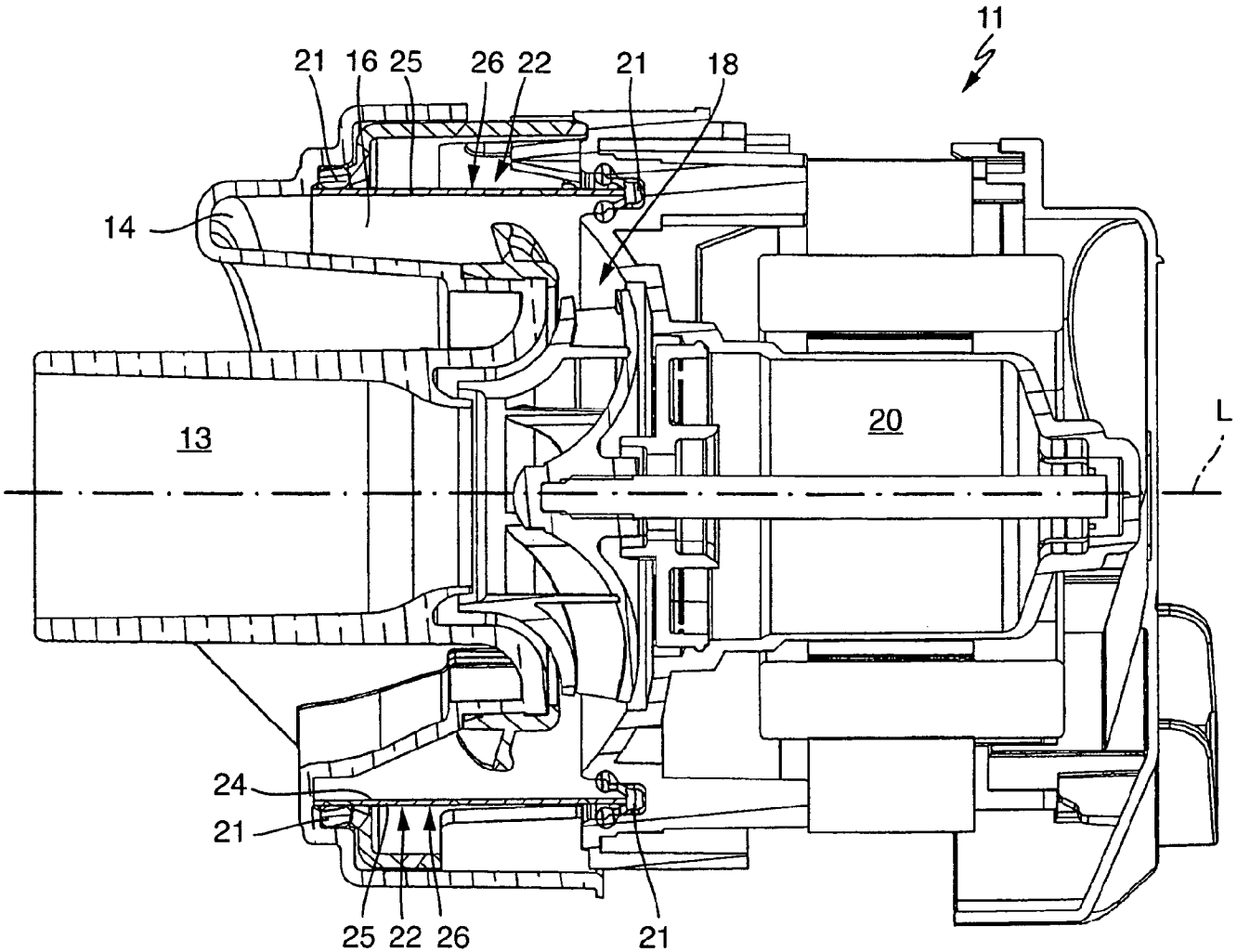
FIG. 1 shows a section through a pump according to the invention having a tubular heating device with heating elements on the outer side.

FIG. 1 shows a pump 11 according to the invention in section, the design of which as a radial pump or impeller pump corresponds substantially to DE 102007017271 A1 mentioned at the outset, to which reference is made in this regard explicitly. It can advantageously be used in a dishwasher or a washing machine. In the left-hand region, the pump 11 has a pump housing 12 with an inlet 13, an outlet 14 and a pump chamber 16. A customary impeller 18 is arranged as rotor or pump impeller close to a pump chamber bottom 17. It is driven by a pump motor 20 which is not described in greater detail. By way of rotation of the impeller 18, fluid is sucked in at the inlet 13 in the axial direction along the longitudinal center axis L (shown using a dashed line) of the pump 11 and is then ejected by the impeller 18 in the radial direction. The fluid is then brought into circulation in the pump chamber 16 and circulates and finally exits from the pump 11 at the outlet 14. To this end, it has an axial flow component in addition to the circulating movement component of the fluid.

The pump chamber 16 is delimited or formed to the outside substantially by a metallic carrier tube 24, and heating elements 26 are provided on its outer side on an insulating layer 25, with the result that a heating device 22 is formed. The carrier tube 24 is arranged sealingly in the pump housing by means of seals or sealing rings 21.

Figure 2:
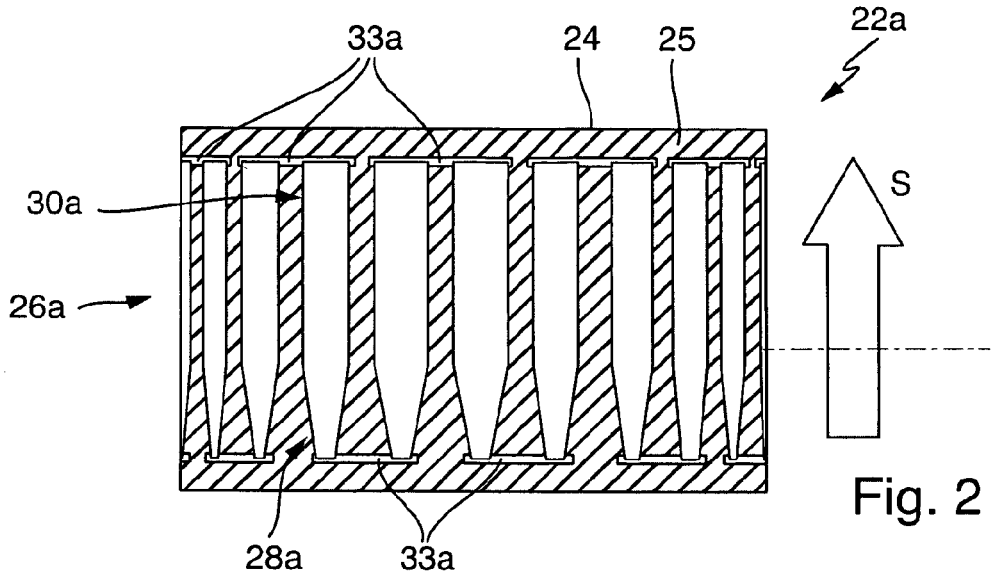
FIGS. 2 to 8 show plan views of alternative heating devices in accordance with FIG. 1 having heating elements which are configured and run in different ways.

FIG. 2 shows an enlarged plan view of a first embodiment of a heating device **22*a* in accordance with FIG. 1. It can be seen how heating elements 26*a* are provided on the carrier tube 24 or on its outer side on an insulating layer 25. The heating elements 26*a* are all of identical configuration and run in the direction of the axial flow component S of the water in the pump chamber 16 in accordance with FIG. 1. Here, the heating elements 26*a* not reach quite as far as the lower and the upper edge of the carrier tube 24, with the result that the carrier tube 24 can be installed satisfactorily with the sealing rings 21 in accordance with FIG. 1**.

The heating elements **26*a* have starting regions 28*a* which are tapered toward the bottom and, after approximately one third of the length, have achieved a width which they then retain as far as upper end regions 30*a*. The thickness of the heating elements 26***a* which are configured as thick film heating elements is identical everywhere here. Here, a pronounced increase in the power output or the thermal energy which is generated is achieved as a result of the reduction in the width at the lower end of the starting regions 28*a*, which width is, in particular, less than half the main width and once again runs as far as the upper end regions 30*a*. A transition of the abovementioned turbulent flow of the conveyed water in the pump chamber 16 outside the impeller 18 on the inner side of the heating device 22 into a laminar flow is indicated on the right next to the heating device 22*a* by way of a dashed line. However, the transition is not as sudden or abrupt as indicated by the dashed line, but rather assumes a defined region, in which the flow gradually changes from turbulent to laminar.

The transition therefore runs somewhat above that region, from which the heating elements 26*a* have reached a constant width or their width and therefore their heating power output no longer change. This means that there is a lower area power output in the region of the laminar flow than in the region of the turbulent flow. Moreover, the area power output in the region of the laminar flow is substantially constant in the direction of the axial flow component.

It can be seen from FIG. 2 that more heating power output is provided or more heat is generated on account of the tapered starting regions 28*a* in the lower region of the heating device 22*a*. Here, in particular, the heating power output can be at least twice that in the upper region close to the end regions 30*a*, and the area power output can therefore also be virtually double.

Figure 3:
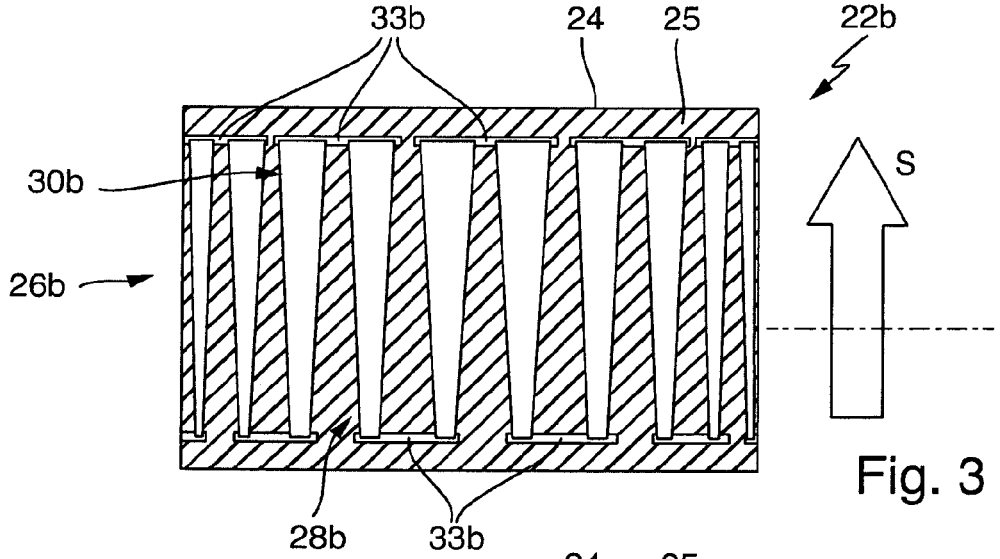

In the further alternative of a heating device 22*b* according to FIG. 3, the heating elements 26*b* are configured in such a way that they become continuously wider in their longitudinal course along the flow direction S from lower starting regions 28*b* as far as upper end regions 30*b* which lie in each case on contacts 33 on the carrier 24 or the insulating layer 25. Here, the smallest width in the lower starting region 28*b* and the greatest width in the upper end region 30*b* correspond approximately to those from FIG. 2. It can also be seen in FIG. 3 that the area power output is greater in the lower region of the heating device 22*b* than in the upper region, the area power output as it were decreasing substantially continuously or uniformly along the axial flow component S, whereas this took place in FIG. 2 just below the dashed transition from the turbulent flow to the laminar flow with a jump or rather in a jump-like manner.

Further variants of the course of the width of the heating elements 26 according to FIGS. 2 and 3 which are not shown in part are readily conceivable to a person skilled in the art. Thus, instead of widening continuously, they can also become wider in a jump-like manner. A combination of uniform and jump-like widenings can also be provided. Uniform widenings are considered, however, to be more advantageous with regard to stream flow and power output generation.

Figure 4:
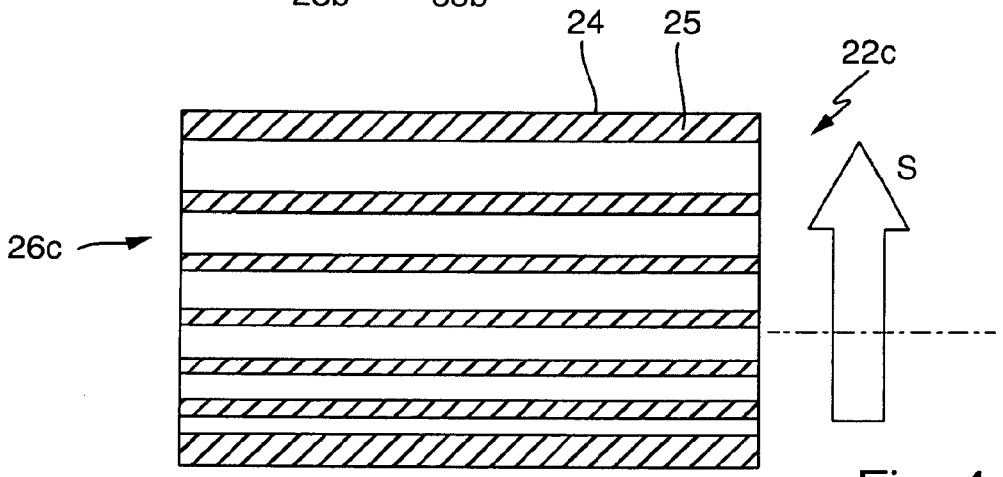

In the further alternative of a heating device 22*c* according to FIG. 4, the heating elements 26*c* then do not run along or in the direction of the axial flow component S, but rather perpendicularly with respect thereto, that is to say in the circumferential direction on the carrier tube 24. It can be seen here that the heating elements 26*c* are considerably narrower in the lower end than the heating elements 26*c* at the upper end, that is to say the width of the heating elements 26*c* increases in the direction S in each case from one heating element to the next. The heating elements 26*c* according to FIG. 4 are in each case at the same spacing from one another.

Overall, the width of the lowermost heating element 26*c* is less than half the uppermost heating element 26*c*. A heating power output which decreases in each case is therefore also provided here as a result of the width of the heating elements 26*c* which increases toward the top. As a consequence, in a similar manner as for the heating devices according to FIGS. 2 and 3, the area power output in the lower region is considerably higher than in the upper region, in particular is at least twice as high. Here, the increase in the width of the heating elements 26*c* from the bottom to the top along the axial flow component S can be uniform, for example by in each case from 20% to 30%.

Figure 5:
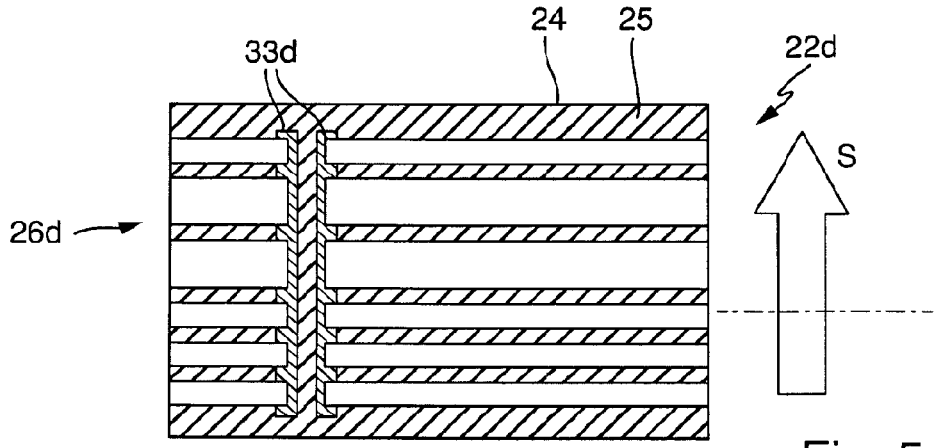

In the further exemplary embodiment of a heating device 22*d* according to FIG. 5, six heating elements 26 are provided, as has otherwise already also been provided in the heating device 22*c* according to FIG. 4. Here, the lowermost three heating elements 26*d* have the same width.

Two heating elements 26*d* which are considerably wider than the lower three, in particular are approximately twice as wide, are provided above the transition (shown using a dashed line) from the turbulent to the laminar flow. Above this, a heating element 26*d* is provided which in turn is considerably narrower, in particular is approximately as narrow as the lower three heating elements 26*d*.

In this way, in the heating device 22*d* according to FIG. 5, the heating power output of the individual heating elements 26*d* and therefore, on account of the respectively identical spacing from one another, the area power output in the lower region of the heating device 22*d* is therefore once again considerably greater than in the upper region, in a similar manner to FIG. 4. Here, however, it has no or only a small change along the axial flow component S in the lower region. The change is then rather jump-like above the transition which is shown using a dashed line, namely in the direction of approximately halving of the area power output.

Toward the very top at the upper end of the heating device 22*d*, the area power output then rises once again as a result of the narrower uppermost heating element 26*d* which once again ensures an increased area power output in the uppermost region. It can be seen from FIG. 1 that this is as close as possible to the outlet 14 from the pump 11, with the result that an attempt is made here finally once again to introduce as much heat as possible into the conveyed water. Here, the flow can also change again from laminar to rather turbulent, with the result that an increased heat transfer is possible.

Unlike FIG. 4, FIG. 5 also shows the electrical contact of the heating elements 26*d* via the two contacts 33*d*. The contacts 33*d* are elongate strips as contact fields, advantageously made from highly electrically conductive material such as for example silver conductive paste or the like. All the heating elements 26*d* are therefore connected in parallel, which also applies to the embodiments of FIGS. 4, 6 and 7. The heating elements 26 of the heating devices 22*a* and 22*b* from FIGS. 2 and 3 were after all connected in series. However, the thickness and composition of the heating elements are also in each case identical or constant in the heating devices according to FIGS. 4 to 7.

Figure 6:
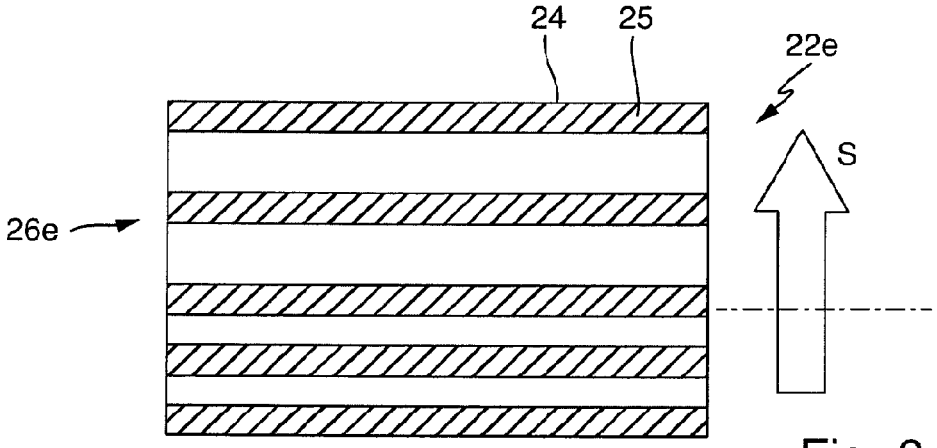

In a further alternative of a heating device 22*e* according to FIG. 6, the respective heating elements 26*e* are in turn at the same spacing from one another. Two lower heating elements 26*e* have the same width and reach approximately up to the transition which is shown using a dashed line. Two heating elements 26*e* which are arranged above the latter are considerably wider, in particular are approximately twice as wide. Although there are therefore only two types or widths of heating elements 26*e* here with in each case a different power output, since the area power output is once again considerably smaller in the upper region of the heating device 22*e* on account of the lower heating power output which is provided than in the lower region, the result here is also the effect according to the invention of an area power output which becomes lower in the axial direction along the flow direction S of the pump 11 toward the outlet 14.

Figure 7:
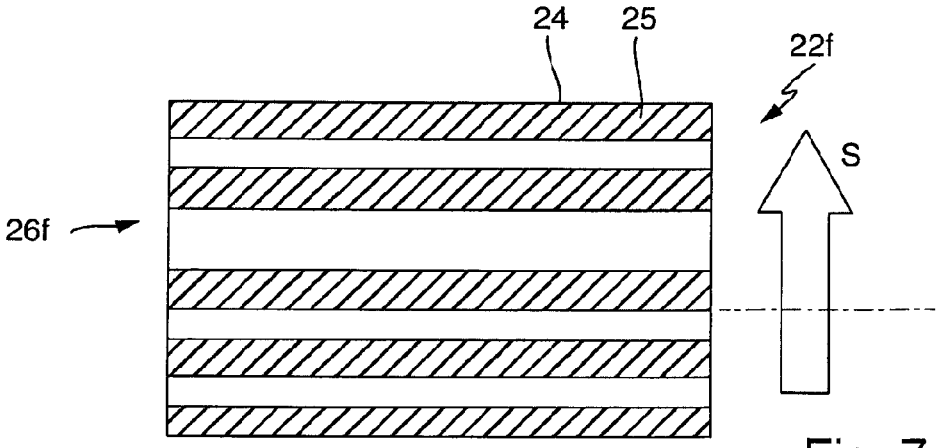

FIG. 7 shows a further alternative of a heating device 22*f* having heating elements 26*f* which once again are all at a constant spacing from one another. Two lower heating elements 26*f* correspond in terms of width to those of the heating device 22*e* from FIG. 6, and they reach as far as approximately the transition which is shown using a dashed line between the turbulent and laminar flow. A wide heating element 26*f* is arranged above this, and a heating element 26*f* which is once again narrow is also arranged above that. In view of the previous explanations, it is clear here that the area power output in the lower region is relatively great, and then the area power output decreases in the region of the wide heating element 26*f* above the transition which is shown using a dashed line, in order then to increase once more toward the top. A similar effect can therefore be achieved here as in the heating device 22*d* according to FIG. 5 which has already been explained above.

Figure 8:
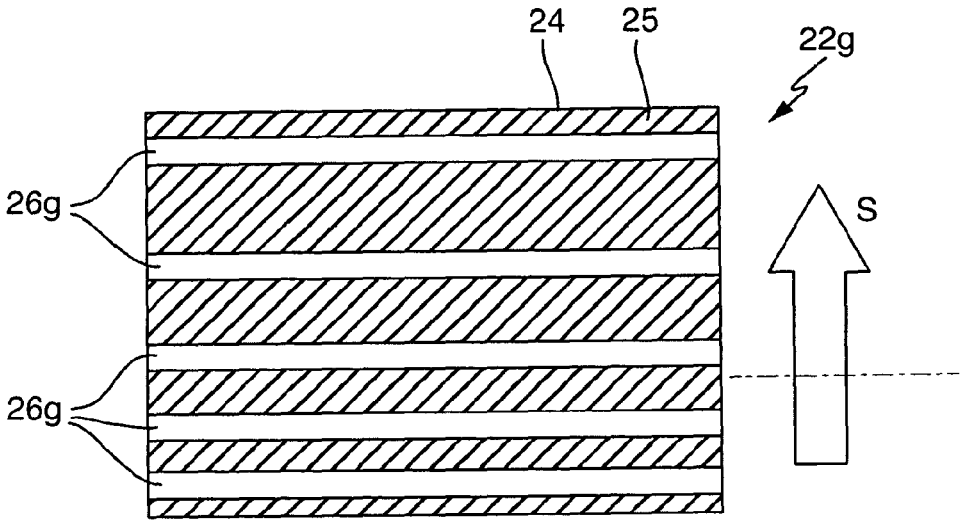

FIG. 8 shows a further alternative of a heating device 22*g*. Here, five heating elements 26*g* are provided which are in each case equally wide, but the spacing of which from one another becomes greater in each case, that is to say increases, along the axial flow component S. Although all the heating elements 26*g* therefore generate the same heating power output, the area power output is at any rate increased according to the invention in the direction S as a result of the respectively increasing spacing from one another. This takes place in a relatively uniform manner, since the spacings also, as it were, become uniformly greater, for example increase in each case by from 20% to 30%. It can be seen that the illustration of FIG. 8 is approximately an inverted illustration of that from FIG. 4, where the individual heating elements 26*c* in each case became uniformly wider, whereas the spacings between them remained identical.

The invention claimed is:

1. A pump for a water-conducting domestic appliance such as a dishwasher or a washing machine, said pump being configured as an impeller pump comprising:

a central water inflow to a rotating impeller for conveying water in a radial direction out of said impeller into a pump chamber surrounding said impeller in a ring-like manner and being delimited on an outer side by an at least partially heated pump chamber wall, said pump comprising an outlet in an end region of said pump chamber at an axial spacing from said impeller, wherein heating elements are arranged on said pump chamber wall and said heating elements have a decreasing power output with regard to an area power output in an axial direction of said pump toward said outlet, and wherein a plurality of said heating elements run substantially in said axial direction of said pump and, in said axial direction, have a smaller width or a smaller cross section at a start close to said impeller than at an end toward said outlet.

2. The pump as claimed in claim 1, wherein said outlet is in a tangential direction from said pump chamber wall.

3. The pump as claimed in claim 1, wherein said heating elements are film heating elements.

4. The pump as claimed in claim 3, wherein said heating elements are thick film heating elements.

5. The pump as claimed in claim 1, wherein, in the case of said individual heating elements, said width or said cross section increases continuously along said axial direction toward said outlet.

6. A pump for a water-conducting domestic appliance such as a dishwasher or a washing machine, said pump being configured as an impeller pump comprising:

a central water inflow to a rotating impeller for conveying water in a radial direction out of said impeller into a pump chamber surrounding said impeller in a ring-like manner and being delimited on an outer side by an at least partially heated pump chamber wall, said pump comprising an outlet in an end region of said pump chamber at an axial spacing from said impeller, wherein heating elements are arranged on said pump chamber wall and said heating elements have a decreasing power output with regard to an area power output in an axial direction of said pump toward said outlet, wherein said heating elements run substantially transversely with respect to said axial direction toward said outlet, a width or a cross section of one said individual heating element remaining unchanged and said width or said cross section of said heating elements which follow one another increasing in said axial direction toward said outlet, and wherein said heating element which is closest to the outlet has a greatest width or a greatest cross section.

7. The pump as claimed in claim 6, wherein said heating elements run substantially transversely with respect to said axial direction toward said outlet in each case so as to surround said pump chamber wall substantially in a ring-like manner.

8. A pump for a water-conducting domestic appliance such as a dishwasher or a washing machine, said pump being configured as an impeller pump comprising:

a central water inflow to a rotating impeller for conveying water in a radial direction out of said impeller into a pump chamber surrounding said impeller in a ring-like manner and being delimited on an outer side by an at least partially heated pump chamber wall, said pump comprising an outlet in an end region of said pump chamber at an axial spacing from said impeller, wherein heating elements are arranged on said pump chamber wall and said heating elements have a decreasing power output with regard to an area power output in an axial direction of said pump toward said outlet, and wherein said heating elements run substantially transversely with respect to said axial direction toward said outlet, said spacing of said heating elements from one another increasing in said axial direction toward said outlet.

9. The pump as claimed in claim 8, wherein said heating elements run substantially transversely with respect to said axial direction toward said outlet in each case so as to surround said pump chamber wall substantially in a ring-like manner.

* * * * *